United States Patent [19]

Remeika

[11] Patent Number: 4,461,336

[45] Date of Patent: Jul. 24, 1984

[54] SYSTEM FOR EMERGENCY INTERRUPTION OF CONTINUOUS CASTING OPERATIONS

[76] Inventor: Victor Remeika, 617-101 Kathleen St., Whitby, Ontario, Canada

[21] Appl. No.: 296,544

[22] Filed: Aug. 26, 1981

[51] Int. Cl.[3] ..... B22D 11/10; B22D 11/16; B22D 41/10

[52] U.S. Cl. ..... 164/155; 164/437; 222/601

[58] Field of Search ..... 164/488, 136, 437, 337, 164/155; 222/599, 601, 606; 266/45, 271, 272

[56] References Cited

U.S. PATENT DOCUMENTS

| | | | |
|---|---|---|---|
| 3,786,962 | 1/1974 | Van Linder | 164/337 X |
| 4,271,896 | 6/1981 | Becus | 164/337 X |
| 4,298,147 | 11/1981 | Honda et al. | 164/437 X |

*Primary Examiner*—Gus T. Hampilos
*Assistant Examiner*—J. Reed Batten, Jr.
*Attorney, Agent, or Firm*—Shlesinger, Arkwright, Garvey & Fado

[57] ABSTRACT

The flow of molten metal from the orifice of a tundish to a continuous casting mold is stopped by a chill plug. The chill plug is attached to an L-shaped arm which is connected to a pivotable arm. The pivotable arm is actuated by a piston-cylinder attached to a bracket on the tundish.

8 Claims, 6 Drawing Figures

FIG. 6
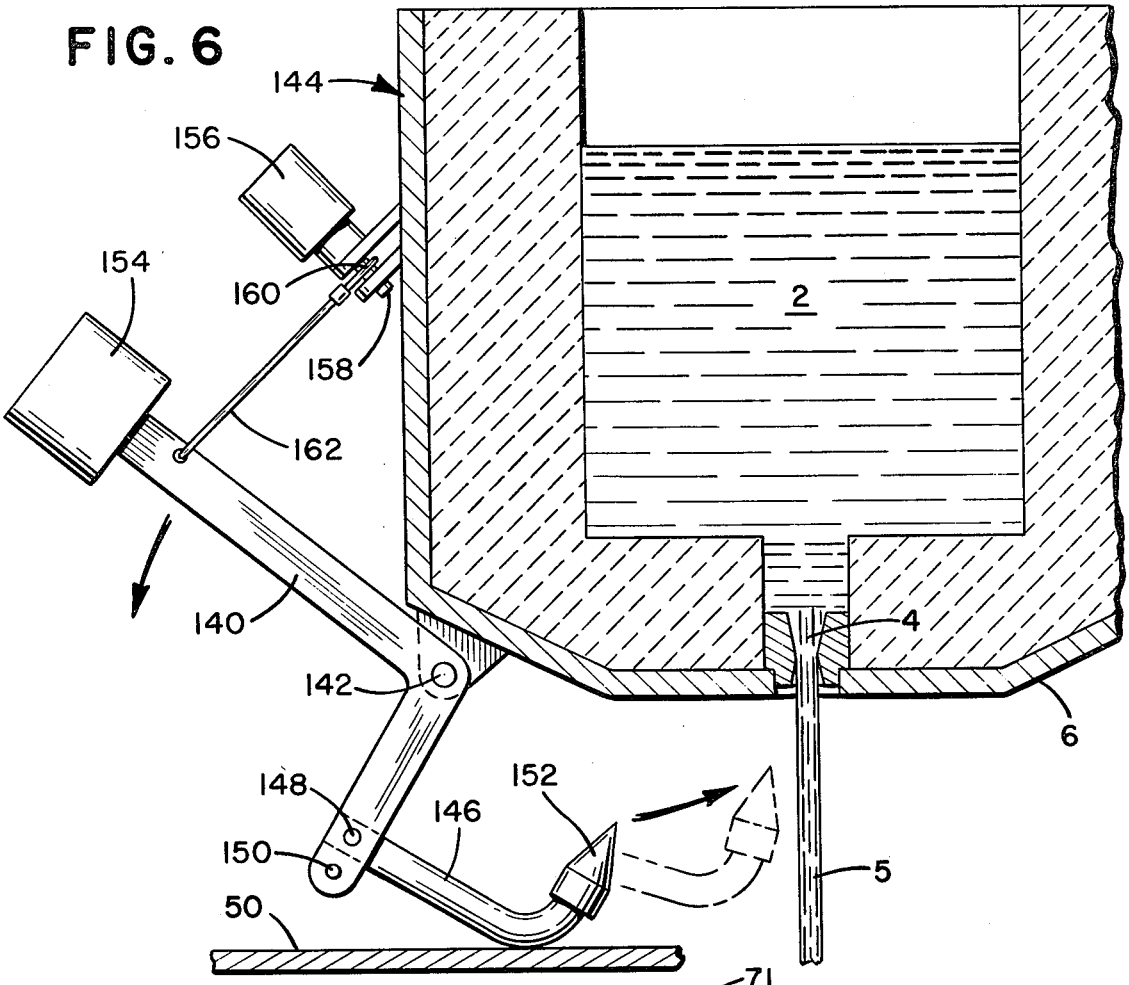
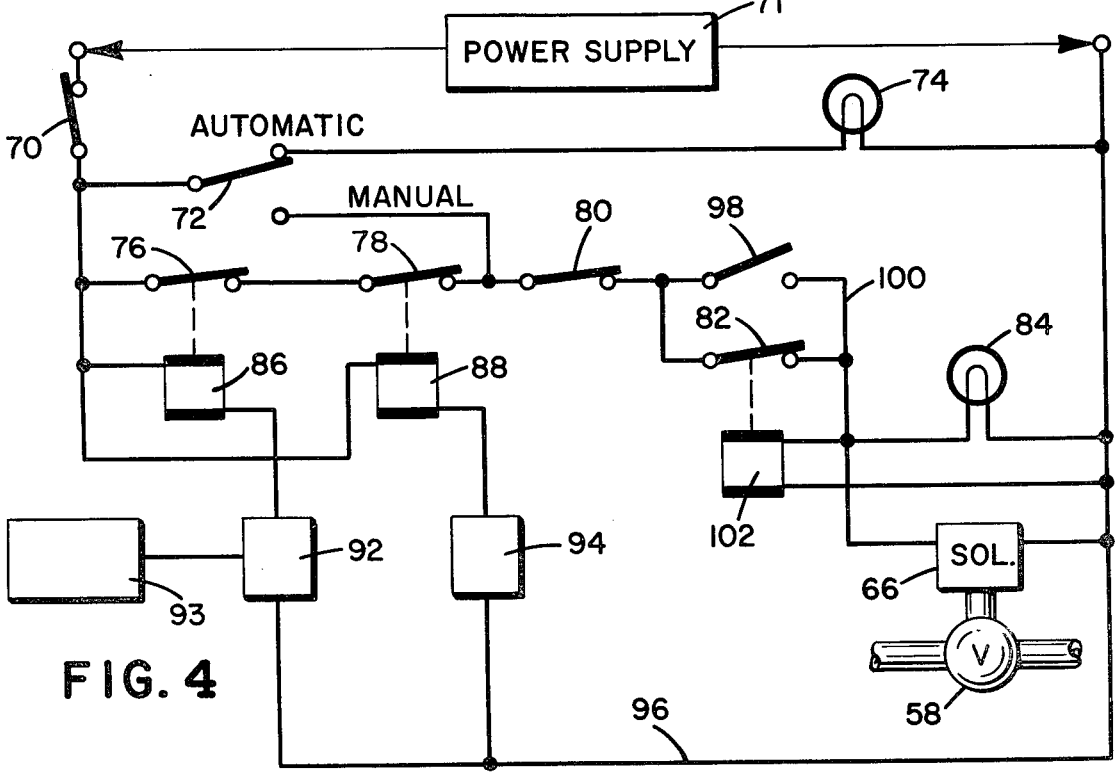
FIG. 4

SYSTEM FOR EMERGENCY INTERRUPTION OF CONTINUOUS CASTING OPERATIONS

This invention relates to continous casting of metal billets or blooms by use of the "open stream" method and more particularly to a system for emergency interruption of molten metal flow from a metering orifice in such an operation.

BACKGROUND OF THE INVENTION

In the continuous casting of metals, the molten liquid is contained in a refractory lined ladle, tundish, or similar vessel. In most cases the metal flows out through an orifice or nozzle in the bottom of the vessel. There are three methods by which the flow of molten material is normally interrupted:

(1) a stopper or plug is inserted from above through the reservoir of liquid;

(2) the use of a valve mechanism of which the nozzle is a part thereof, and which is commonly referred to as a "slide gate"; and (3) the use of a chill plug which is inserted from below. The latter method, to which this invention applies, is generally preferred for the continuous casting of steel billets. In such an operation the chill plug is usually a conical block of copper attached to a bent steel bar. The operator, using the bar as a handle, inserts the plug in the nozzle or orifice and holds it there until the liquid solidifies in the nozzle.

The interruption of flow is often necessitated by emergency conditions, such as a power or water supply failure which affects the casting machine operation. The manual insertion of the chill plug as described above has several disadvantages, the most important being the risk that the operator may be splashed by molten metal and the time lapse between the occurrence of a fault and the interruption of the flow. The operator is generally unaware of the fault until it has a visible effect, such as a sudden change in the level of the meniscus in the mold. This delay is extended by the operator's response time. Manual insertion of the chill plug has heretofore been considered necessary because clearance between the tundish and mold is usually less than sufficient to permit the installation of common mechanical devices capable of performing the operation.

OBJECTS AND SUMMARY OF THE INVENTION

It is therefore an object of the present invention to provide a system for interrupting the flow of molten metal from an orifice which reduces the time lapse between the occurrence of a fault and the interruption of the flow.

Another object of the present invention is to provide apparatus for emergency interruption of the flow of molten metal from an orifice wherein an operator's access to the mold is not restricted.

Still another object of the present invention is to provide a system for emergency interruption of molten metal flow through an orifice which will prevent production delays and the possibility of damage to the casting apparatus.

A further object of the present invention is to provide apparatus for interrupting the flow of molten metal from an orifice which may be operated manually or by an automated control system.

Still a further object of the present invention is to provide emergency interruption of molten metal flow from an orifice which minimizes the risk of injury to production workers thereabout.

DESCRIPTION OF THE DRAWINGS

These and other advantages of the present invention will become apparent when considered in accordance with the following description and drawings in which:

FIG. 4 is a schematic drawing of the control system;

DETAILED DESCRIPTION OF THE INVENTION

Figure 1:
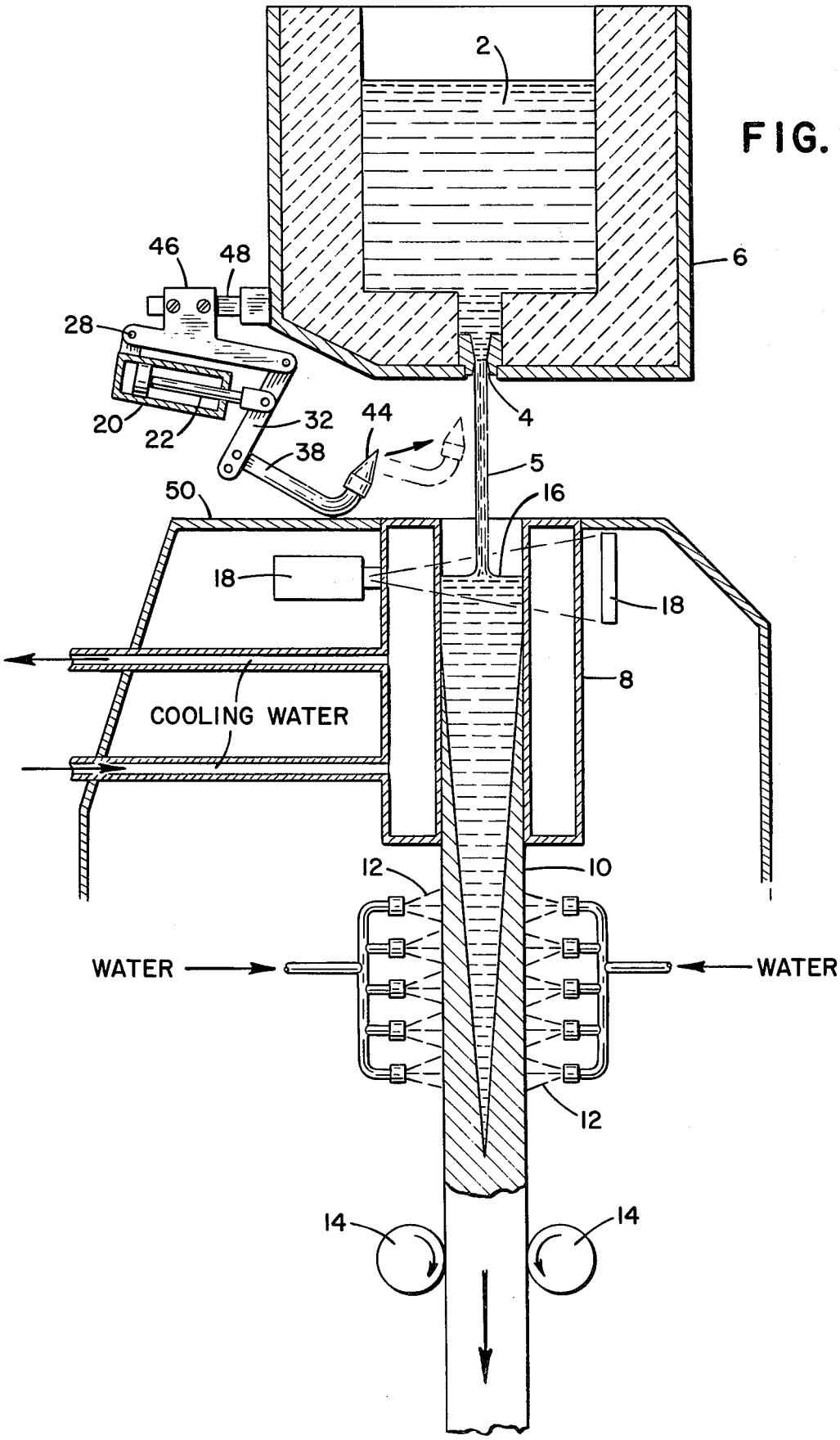
FIG. 1 is a sectional view of the continuous casting apparatus including a schematic representation of the molten metal flow interruption apparatus.
Figure 2:
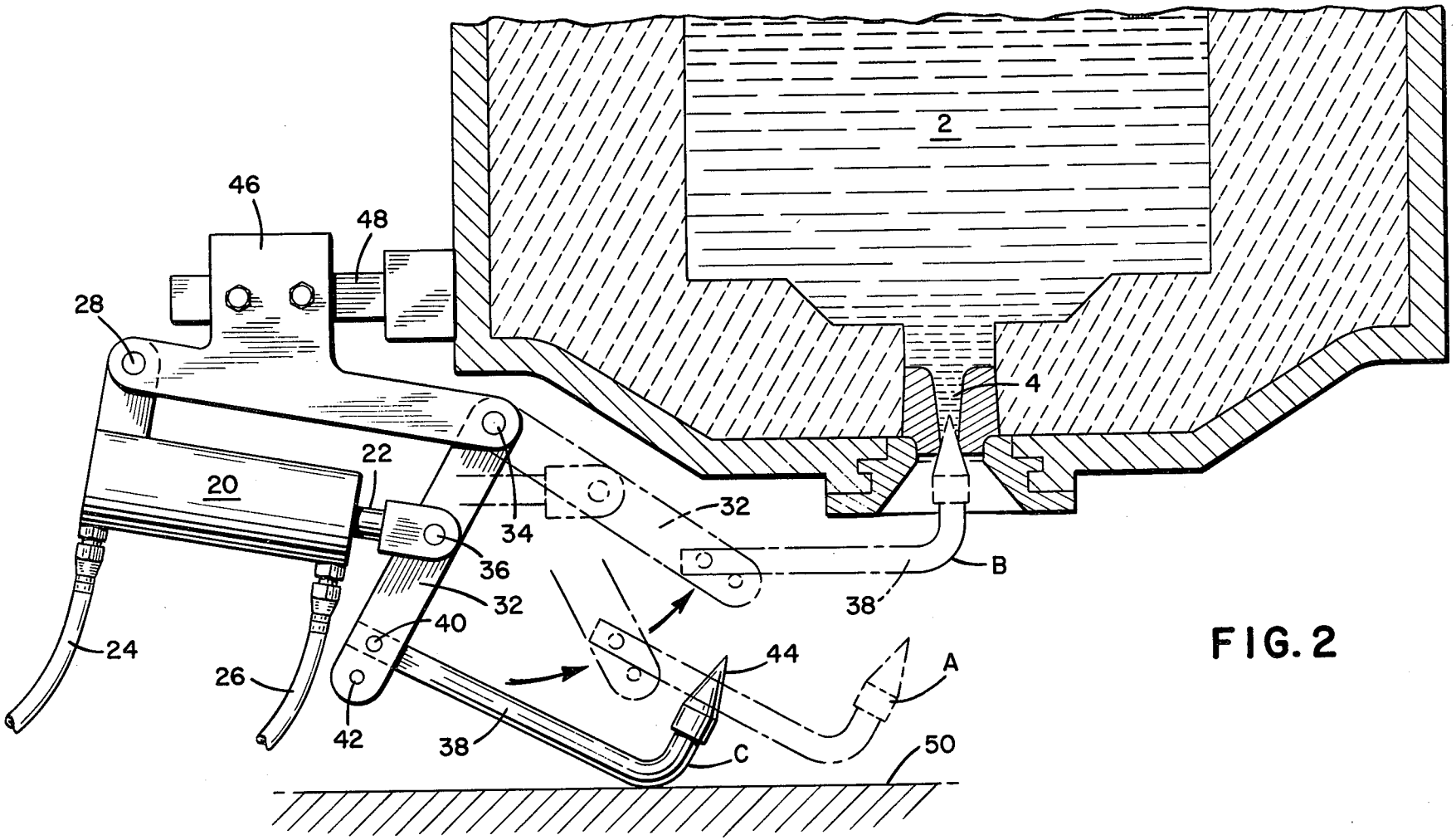
FIG. 2 is a fragmentary sectional view of the molten metal interruption apparatus as shown in FIG. 1, enlarged for clarity.

Referring firstly to FIGS. 1 and 2, in the continuous casting of metal billets or blooms, molten metal 2 flows freely through a metering nozzle or orifice 4 in the bottom of a refractory-lined tundish 6. The stream of molten metal 5, which may be protected from oxidization by gaseous or liquid nitrogen or argon, falls into a water-cooled mold 8 which causes part of the metal to freeze, forming a shell 10 which acts as a container for the remaining molten metal.

In steady state conditions, shell 10 and its contents are continuously withdrawn from the bottom of mold 8 into a region where water sprays 12 cause the solidification process to continue. The withdrawal rate is a function of the speed of pinch rolls 14 which are automatically adjusted so that the level of meniscus 16 is held constant. This level is sensed by infrared measurements, or by measurements of the signal from a radioactive source 18.

The device for interrupting the flow of molten metal 2 from orifice 4, as shown in detail in FIG. 2, includes a pneumatic cylinder 20 having piston rod 22, air lines 24 and 26 and being attached by pivot 28 to clamp 46. An air cooled housing (not shown) may surround cylinder 20 if desired. A first arm member 32 is pivotally connected to arm member 32 at pivot 36. A second, generally L-shaped member 38 is pivotally connected to arm member 32 at 40. Stop pin 42 is provided at the lower end of arm member 32 for acting as a reset or stop for arm member 38 as shown in positions A and B. Attached at the end of arm member 38 is a conically shaped chill plug 44. An adjustable clamp 46 is attached to a bracket 48 which is mounted on the side of tundish 6. When at rest as shown in position C, arm member 38 may rest upon mold cover 50

Figure 3:
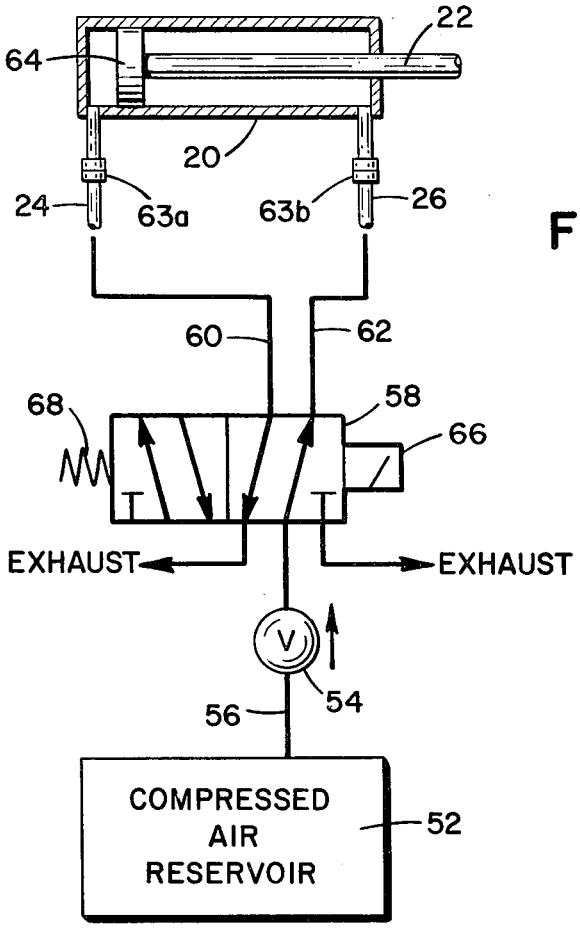
FIG. 3 is a schematic drawing of the pneumatically powered cylinder apparatus.

As schematically shown in FIG. 3, an air reservoir 52 supplies air through a main air valve 54 via air line 56, into solenoid valve 58, which depending upon its position, supplied air via air lines 60 or 62 to air lines 24 or 26 respectively and consequently to pneumatic cylinder 20. Air lines 60 and 24, and air lines 62 and 26 are connected by quick release couplings **63*a* and 63*b* respectively. FIG. 3 shows piston 64 in the retracted position, as solenoid 66 is activated and bears against spring 68**.

When power is cut off to solenoid 66 spring 68 forces valve 58 into its alternate position so that air entering valve 58 through air line 56 is rerouted to line 62 thereby forcing piston 64 to the right as seen in FIG. 3 to extend the piston rod 22.

Referring now to FIG. 4, a control circuit which is responsive to preset operational limits is used to deactivate the solenoid 66, which deactivation will cause insertion of the chill plug 44. The control circuit includes a master switch 70 which controls the supply of power to the circuit. From the master switch 70 current flow through relay switches 76 and 78, the normally closed release switch 80, and the reset relay switch 82 to the solenoid 66 of valve 58, to reset light 84, and to coil 102 of relay switch 82 thus holding said normally open switch 82 in the closed position. The normally open relay switches 76 and 78 are held closed by coils 86 and 88 respectively. Said coils are connected to the power supply through line 90 on one side and to detectors 92 and 94 on the other. Detectors 92 and 94, which are used to sense changes in process conditions as will be discussed more fully hereinafter, are in turn connected to the power supply through line 96. The circuit also includes a manual-automatic selector switch 72, which is a manually operated single pole double throw toggle switch or suitable similar switch. When selector switch 72 is in automatic mode, as shown as solid line, an ¢automatic" indicator light 74 is illuminated, and it may be readily seen that when the selector switch 72 is in manual position, as shown by dotted line, relay switches 76 and 78 are by-passed.

To activate the circuit the master switch 70 is closed, selector switch 72 is placed in manual position and momentary contact switch 98 is used to supply power through line 100, activating solenoid coil 66, reset light 84 and relay coil 102, which in turn closes the normally open relay switch 82. Thereafter current may flow through switch 82 to coil 102, light 84 and solenoid 66 even after switch 98 has been release and has returned to its normally open position.

If it should be desired to manually stop the casting process, manual opening of the manual release switch 80 will interrupt the flow of current to the solenoid coil 66, causing insertion of the chill plug 44 into the orifice 4, and to coil 102 thereby permitting relay switch 82 to open thus preventing re-activation of solenoid coil 66 when manual switch 80 is released. If selector switch 72 is in the automatic position, a pre-selected change in a process condition may cause either of the relay switches 76 and 78 to open, thereby interrupting the flow of current to solenoid coil 66 and relay coil 102, causing insertion of the chill plug 44 into orifice 4 and opening relay switch 82. Although only two relay switches 76 and 78 are shown, any number of such controls may be inserted in series depending upon the number of process variables to be monitored.

The detectors 92 and 94 may be the same or different, depending upon the process variable to be monitored. One such sensor would be that indicated at 18 in FIG. 1 which monitors the level of the meniscus 16 in the mold 8. Thus, when the level of the meniscus rises or falls below predetermined limits the current flowing from line 96 to, for example, coil 86 would be interrupted thereby allowing switch 76 to open, de-energizing solenoid coil 66, stopping the flow of molten metal and thus minimizing the risk of injury to operators and damage to equipment.

Other sensors could be utilized to detect an interruption in the supply of water to the mold 8 or the sprays 12, to detect excessive speed of the pinch rolls 14, or to detect other process conditions which might cause damage to equipment, injury to operators or which might affect product quality. The sensors used are of well known types, and the particular type would of course depend upon the particular process variable being monitored. It will readily be appreciated that a power supply failure will similarly de-energize the solenoid coil 66 and stop the flow of molten metal.

Figure 5:
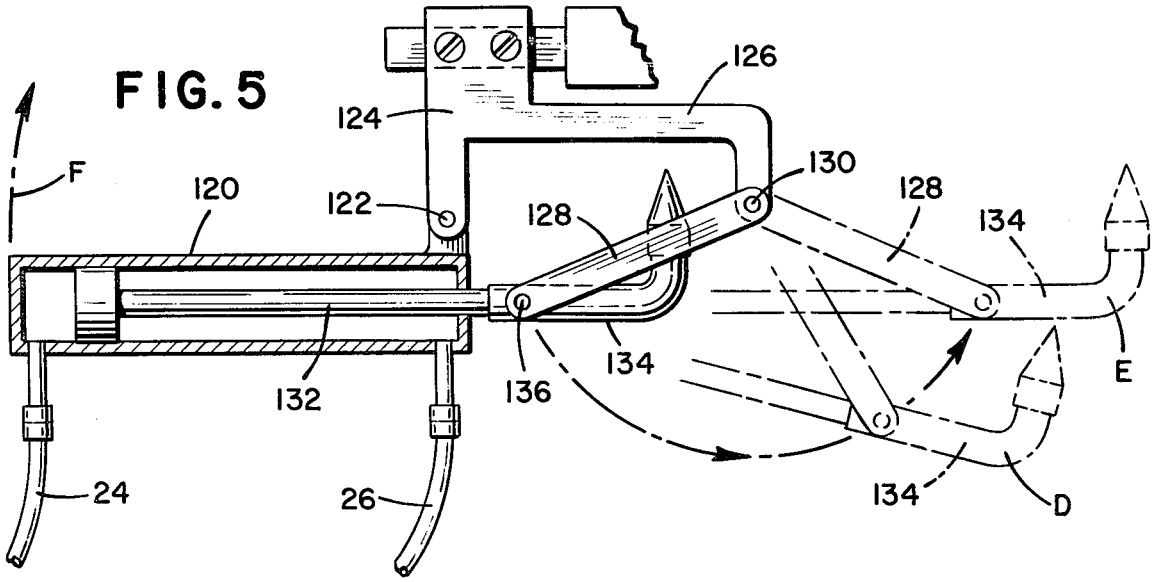
FIG. 5 is a schematic drawing of an alternative embodiment of the device shown in FIG. 2; and, FIG. 6 is a schematic drawing of another alternative embodiment of the device shown in FIG. 2.

As shown in FIG. 5, an alternative embodiment for the actuator/linkage assembly is shown. In this embodiment, pneumatic cylinder 120 is pivotally connected at 122 to adjustable clamp 124 having a L-shaped extension 126. A first arm member 128 is pivotally connected to L-shaped extension 126 at 130. Rigidly connected to piston rod 132 is a second arm member 134. Arm member 134 is also pivotally connected to arm member 128 at 136.

OPERATION OF THE INVENTION

Prior to the start of the casting operation, clamp 46 is fitted on bracket 48 and the position of the assembly is adjusted in relation to orifice 4. Clamp 46 is then tightened and air line 60 is then joined to air line 24 by quick release coupling **63*a*, while air line 62 is joined to air line 26 by means of quick release coupling 63*b*. Master switch 70 is then closed, switch 72 is set to the manual position, and reset button 98 is pushed, thus activating solenoid 66 and valve 58. Main air valve 54 is then opened, causing plug 44 to retract. When the casting operation has been started, switch 72 is moved to the automatic position. The linkage is automatically held in retract position until such time as the system is triggered by a control signal from one of the sensors, or by manual override opening switch 80**.

The system is triggered (1) by failure of power supply, 71, (2) by the operator, or (3) by an electrical signal, from any one of a number of sending or indicating devices produced when a process variable has reached a preset limit. The signals which trigger the system are selected to suit to the specific operation. They may indicate any or all of the following as well as other limits which have been reached or exceeded: high withdrawal speed; low withdrawal speed; low flow of spray water; low flow of mold water; high temperature of the mold water at the inlet or outlet; high meniscus level; low meniscus level; and low level of molten metal 2 in tundish 6.

When one of the above present limits has been exceeded, power to solenoid 66 is cut off causing solenoid responsive valve 58 to shift positions due to the force of spring 68 acting thereupon. Shifting of solenoid responsive valve 58 from its normally activated position as shown in FIG. 3, causes air to be supplied to air lines 62 and 26. Thus, piston 64 and piston rod 22 forces the linkage assembly, with attached plug 44, sequentially into positions A and B, thereby completely interrupting the flow of molten metal 2 from orifice 4.

The novel arrangement of the linkage assembly and more particularly the use of dual pivotal points 34 and 40, permits the apparatus to be mounted on the side of tundish 6, away from the streams of molten metal 2, thereby providing worker access to mold 8 during normal casting operations. In addition, the novel assembly of the present invention eliminates the need for manual plugging of orifice 4 which in the past was necessitated by limited clearance between tundish 6 and mold 8. Furthermore, attachment of the apparatus to the side of tundish 6 eliminates molten metal 2 from spashing thereon, thus reducing the occurance of malfunction or breakdown.

In the embodiment shown in FIG. 5, pneumatic cylinder 120 is pivotally connected at 122 to adjustable clamp 124. When air is supplied through air line 26 into pneumatic cylinder 120, pneumatic cylinder 120 will pivot from its normally horizontal position in a clockwise direction along arc F while the linkage assembly assumes position D. As the linkage proceeds from position D to position E, pneumatic cylinder 120 will then pivot in a counter clockwise direction until it has again assumed position E. The pivotal movement of pneumatic cylinder 120 is due to the connection of piston rod 132 to arm member 128.

When conditions have returned to normal, solenoid 66 may be reactivated by pushing reset button 98, thereby causing solenoid responsive valve 58 to return to its normal position. Thus, air is now supplied to air lines 60 and 24, subsequently causing piston rod 22 or 132 with their respective linakges to retract the chill plug.

At the end of the cast the operator will close main air valve 54, disconnect couplings 63*a* and 63*b*, open master switch 72, loosen clamp 46 and remove the assembly. If the system has been activated he may disconnect chill plug 44 from the linkage before removing the assembly.

It will be appreciated that the control circuit described above can be readily replaced by a programmable logic controller or equivalent device whose functions are determined by the program which can be easily modified or altered.

In some cases, or for example in association with certain of the condition sensors, a pre-set or adjustable timing device shown at 93 in FIG. 4 may be used to delay deactivation of the solenoid coil for a few seconds or fractions thereof. In this manner termination of the operation could be prevented when control limits are exceeded only momentarily. For example, it may not be necessary to shut down the process as a result of a minor, momentary meniscus level fluctuations.

The linkage arrangements either of FIG. 2 or FIG. 5 provide a further significant advantage due to the nature of the linkage system. Specifically, it is quite common for the tundish to be located in close proximity to the mold, whereby the clearance between the two pieces of equipment is minimal. A cumbersome linkage arrangement which would swing through a circular arc from outside of the periphery of the tundish to the center thereof would not be possible in that the radius of the arc would ordinarily be greater than the spacing between the tundish and the mold. The linkage arrangements as described above use a specific compound linkage arrangement so that the path of the chill plug when it first starts moving toward the orifice is more horizontal than vertical, and as the path continues, it becomes more vertical and less horizontal. In other words the path of the chill plug is more rectangular or elliptical according to the present invention. This accomplished according to the FIG. 2 embodiment wherein a type of lost motion occurs as the arm 32 begins pivoting until the point where the stop pin 42 engages the arm 38, approximately at position A, whereupon the stop pin 42 imparts a vertical movement to the chill plug.

Similarly, in the FIG. 5 embodiment, an over-center motion arrangement is provided when the cylinder 120 first pivots in a clockwise direction about connection 122, and then returns in a counter clockwise direction.

It will be clear that the pneumatic cylinder may be replaced by a hydraulic cylinder with concurrent changes in the fluid handling portion of the system.

FIG. 6 shows still a further embodiment which is similar to FIG. 1, but in which the piston and cylinder arrangement is replaced by a simple counterweight. In this embodiment, a generally L-shaped bracket 140 is pivotally mounted at 142 to the tundish 144. Another generally L-shaped bracket 146 is connected to the bracket 140 by a pivotal connection at 148. A stop pin 150 is provided and functions similarly to stop pin 142. The chill plus 152 is carried by the arm 146.

The other end of the arm 140 is provided with a counterweight 154.

Suitably mounted on the tundish 144 is a solenoid 156 which is operable to retract a plunger 158. When the solenoid 156 is energized, the plunger 158 is in the position shown, and passes through a loop or eye 160 on cable or rod 162. The other end of the cable or rod 162 is connected to the arm 140 in a suitable fashion. Upon receipt of an appropriate signal, the solenoid 156 is de-energized so as to retract the plunger 158. In so doing, the rod 162 is released and the counterweight 154 serves to rotate the arm 140 in the direction of the arrow, and thereby insert the chill plug 152 into the orifice of the tundish 144.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. In a continuous casting apparatus comprising a tundish for discharging molten metal through an orifice into a remote mold having a mold cover, an apparatus for interrupting the flow of molten metal from the tundish, comprising:

(a) actuator means connected to said tundish;
(b) a chill plug insertable into said orifice for sealing said orifice for stopping flow of molten metal therethrough;
(c) linkage means having a first pivot connected to said actuator means;
(d) an L-shaped arm having a base leg and an upright leg, said chill plug mounted on said base leg;
(e) said linkage means having a second pivot remote from said chill plug;
(f) said L-shaped arm connected at said upright leg to said second pivot;
(g) said second pivot spaced from said first pivot;
(h) stop means on said linkage means positioned below said second pivot and adjacent thereto for limiting downward pivoting of said L-shaped arm and said chill plug;
(i) said second pivot being positioned between said first pivot and said stop means;

(j) said upright leg having a portion thereof engageable with said stop means between said second pivot and said base leg; and, (k) when said actuator is operating, said L-shaped arm is caused to first move laterally and with unrestricted pivotal movement about said second pivot and subsequently to engage said stop means, thereby restricting pivotal movement of said L-shaped arm about said second pivot to cause said L-shaped arm and said linkage means to move unitarily about said first pivot and engage said chill plug in said orifice.

2. An apparatus as in claim 1 wherein said actuator means comprises fluid operated piston and cylinder means, means for supplying fluid under pressure to said piston and cylinder means, and said first pivot being attached to the piston of said piston and cylinder means.

3. An apparatus as in claim 2 wherein said linkage means is pivotally attached to bracket means fixedly mounted on the tundish.

4. An apparatus as in claim 3 wherein said piston and cylinder means is mounted on said bracket means.

5. An apparatus as in claim 4 wherein said piston and cylinder means is pivotally mounted on said bracket means.

6. An apparatus as in claim 1, 4 or 5 further including valve means for directing the supply of pressurized fluid to said piston and cylinder means and electrical means for controlling said valve means.

7. An apparatus as in claim 6 wherein said valve means comprises a solenoid valve and said electrical control means includes sensor means responsive to a predetermined condition for admitting pressurized fluid to said piston and cylinder means and causing travel of said chill plug from a retracted position to said orifice for stopping the flow of molten metal therethrough.

8. An apparatus as in claim 7 further including manual electrical reset means for returning said chill plug to said retracted position.

* * * * *